United States Patent [19]

Bielfeldt

[11] Patent Number: 4,997,514

[45] Date of Patent: Mar. 5, 1991

[54] DEVICE FOR MANUFACTURING OF A LAMINATED WOOD PANEL

[75] Inventor: Friedrich B. Bielfeldt, Eppingen, Fed. Rep. of Germany

[73] Assignee: Maschinenfabrik J. Dieffenbacher GmbH & Co., Eppingen, Fed. Rep. of Germany

[21] Appl. No.: 328,393

[22] Filed: Mar. 24, 1989

[30] Foreign Application Priority Data

Mar. 24, 1988 [DE] Fed. Rep. of Germany ..... 3809989

[51] Int. Cl.[5] ..... B30B 7/04; B30B 15/06

[52] U.S. Cl. ..... 156/558; 100/93 P; 100/154; 100/232; 144/242 E; 144/348; 144/352; 156/555; 156/559; 156/580; 156/583.1; 156/583.5

[58] Field of Search ..... 156/558, 559, 580, 583.1, 156/583.5, 555; 100/93 P, 196, 222, 232, 154; 144/256.2, 242 E, 348, 352

[56] References Cited

U.S. PATENT DOCUMENTS

| | | | |
|---|---|---|---|
| 3,191,522 | 6/1965 | Drake et al. | 100/93 P |
| 3,444,029 | 5/1969 | Renaud et al. | 100/93 P |
| 4,101,370 | 7/1978 | Russell | 100/154 |
| 4,547,255 | 10/1985 | Yow | 156/580 |
| 4,747,899 | 5/1988 | Hasegawa | 144/352 |

FOREIGN PATENT DOCUMENTS 3517449 1/1987 Fed. Rep. of Germany .

*Primary Examiner*—Michael Wityshyn

*Attorney, Agent, or Firm*—Foley & Lardner, Schwartz, Jeffery, Schwaab, Mack, Blumenthal & Evans

[57] ABSTRACT

A laminated wood panel manufacturing device is provided for use with daylight presses. A pressure strip is arranged in a longitudinal direction of the press. Parallel upper and lower lids are attached to the pressure strip and extend in a transverse direction toward the press. The lids are vertically adjustable by means of adjusting screws. The pressure strip assembly is moved in a transverse direction of the press so that, during pressing, the upper and lower lids abut upper and lower board layers of a laminated stack to press the board layers together in a transverse direction of the press.

21 Claims, 4 Drawing Sheets

DEVICE FOR MANUFACTURING OF A LAMINATED WOOD PANEL

BACKGROUND OF THE INVENTION

1. Field of the Invention

The invention relates to a device for manufacturing laminated wood panels, and more particularly to a laminated wood panel manufacturing device having pressure strips of adjustable height allocated to each daylight stage.

2. Discussion of Related Art

Laminated wood panels consisting of a core layer and facing layers, also called bench panels, blockboard panels or plywood panels, are known in the art. German Offenlegungsschrift 3,517,449 discloses a method of manufacturing a laminated wood panel, wherein the laminated stacks, consisting of a core layer and facing layers applied to both sides, are put into the daylight stages of a multi-daylight press (also called a platen press), put down onto the heating plates and pressed. In this reference, the daylight stages are closed by lowering the upper heating plates until contact is made with the upper facing layers. Then the facing layers, which consist of wooden boards, are pressed together without gaps by means of pressure strips of a pressure device and, after the daylight stages are closed, pressed with the full pressing power and the heating energy provided.

According to this method, however, faulty pressings could be caused by the wooden boards wedging between pressure strips and heating plates when being pushed together without gaps. This disadvantage could occur in a feed system in which the individual laminated stacks are placed onto separate conveying plates and moved into the press. After the pressing, the conveying plates are conveyed out again and, in a plate-circulating system, are supplied again to the feed system for the press.

Another well-known method comprises a feed system which has no conveying plates and in which feeding and emptying is effected by endless conveying belts which are guided around the heating plates. In this system, the conveying belts can be made of steel or temperature-resistant plastic sheeting. Here, for feeding, pressing and emptying, the conveying belts must have a width which is greater than that of the laminated stacks to be processed. If narrower conveying belts were used, their lateral edges would leave a mark on the finished laminated wood panel. However, producing with projecting conveying belts again has the disadvantage that the pressure strips can seize and compress the conveying belts. In the process, folds can form or the conveying belts may even be destroyed.

In the press according to German Offenlegungsschrift 3,517,449, described above, distance strips of appropriate thickness are used for the particular thicknesses of laminated stacks to be pressed. This has the disadvantage that, for every new series of laminated stacks, the distance strips also have to be exchanged. Apart from the changeover time, this also calls for costly stock-keeping of the individual thicknesses of distance strips.

SUMMARY OF THE INVENTION

Accordingly, the object of this invention is to provide a device for manufacturing laminated wood panels wherein no faulty pressing results and all the thicknesses of laminated stack can be manufactured with one distance strip.

A further object of the present invention is to provide a device wherein during a production change in the thicknesses of the laminated stack, only the upper lid of the box-shaped distance strips has to be adjusted.

Another object of this invention is to provide a device wherein the adjustment can be effected as quickly as possible by a favorable configuration of the means of adjustment.

Still a further object of this invention is to provide a device wherein the conveying belts are always located between the pressure strips and the heating plates so that, during the pressure operation when the press is not quite closed, scraping of the pressure strips on the conveying belts is impossible.

The present invention comprehends a laminated wood panel manufacturing device for use with daylight presses. A pressure strip is arranged in a longitudinal direction of the press. Parallel upper and lower lids are attached to the pressure strip and extend in a transverse direction toward the press. The lids are vertically adjustable by means of adjusting screws. The pressure strip assembly is moved in a transverse direction of the press so that, during pressing, the upper and lower lids abut upper and lower board layers of a laminated stack to press the board layers together in a transverse direction of the press.

Further advantages of this invention will become apparent hereinafter in the specification and drawings which follow.

DETAILED DESCRIPTION OF THE PREFERRED EMBODIMENTS

Figure 1:
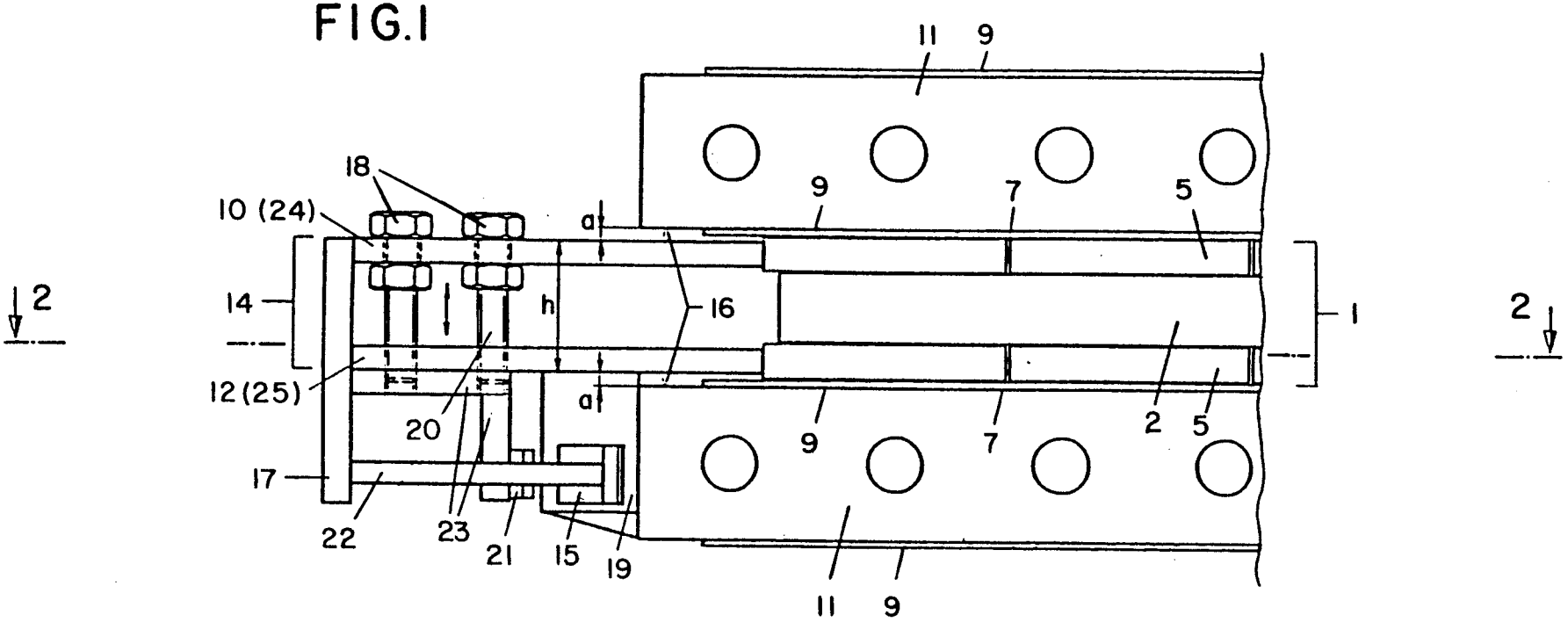
FIG. 1 is an end view of a multi-daylight press according to a preferred embodiment of the present invention.

As illustrated in FIG. 1, a side view of a multi-daylight press is shown without frame, press bed or pressing ram. The individual heating plates 11 can be controlled at exactly the same distances apart via a simultaneous closing means (not shown) during closing and opening of the daylight stages.

A pressure strip 14, adjustable in its height "h", is allocated to each daylight stage and longitudinal side. The pressure strip 14, with an adjustable distance "a", is displaceably guided into the pressing area above and below, respectively, as well as parallel to the pressing surface 16 by means of a pressure device 15, 17 and 22 in a support device comprising a guide bracket 19. In this arrangement, the pressure strips 14 are each constructed as an open-ended box which is adjustable in its thickness and whose upper and lower lids 10 and 12 can be moved away from and toward one another (thus altering "h") by means of adjusting screws 18 which are freely rotatable in the upper lid 10 and mesh in threads 20 in the lower lid 12. The pressure device 15, 17 and 22 comprises a cylinder 15, a piston 22 guided therein and a thrust strip 17 firmly connected to the piston 22. The lower lid 12 is firmly connected to the thrust strip 17 and slides on an upper side of guide bracket 19 in which the cylinder 15 is also arranged. The upper lid 10, on the other hand, is adjustably attached at height "h" by means of adjusting screws 18 in tapped holes 20 in the lower lid 12.

The representation in FIG. 1 shows the production operation when the upper heating plate 11 or pressing ram has already come down onto the upper facing layer 3, but the wooden boards 5 can still move horizontally. The pressure device 15, 17 and 22 plus the support device 19 and the pressure strips 14 can be arranged on one side or both sides of the heating plates 11. Depending on the layout, however, it is sufficient for stop strips (not shown) which absorb the counterpressure to be fixed on one side in the daylight stages.

Figure 2:
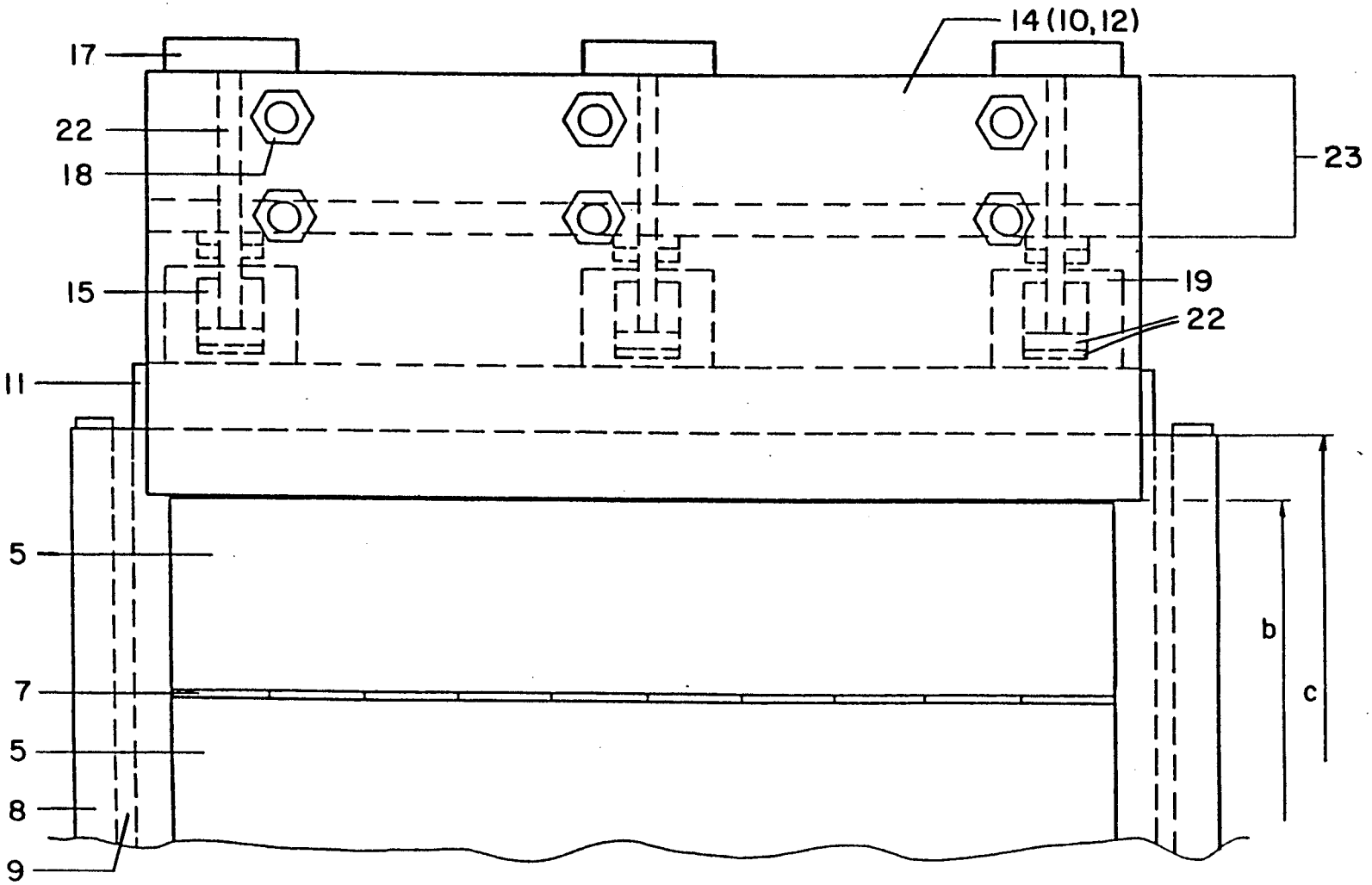
FIG. 2 is a section 2—2 from FIG. 1.

As shown in FIG. 1, the adjustable distance "a" is selected to be the same as or greater than the thickness of conveying belt 9. This prevents the pressure strips 14 from damaging the conveying belts 9 during their thrust movements. For this purpose, it is necessary that the pressure strips 14, in the extended position, leave a smaller pressing width clearance than is covered by the width "c" of the conveying belt, as shown in FIG. 2. So that the lateral edges of the conveying belt 9 do not leave any impressions in the finished laminated wood panel, it is also necessary to make the widths "b" of the laminated stacks 1 not greater than the widths "c" of the conveying belt 9.

Figure 4:
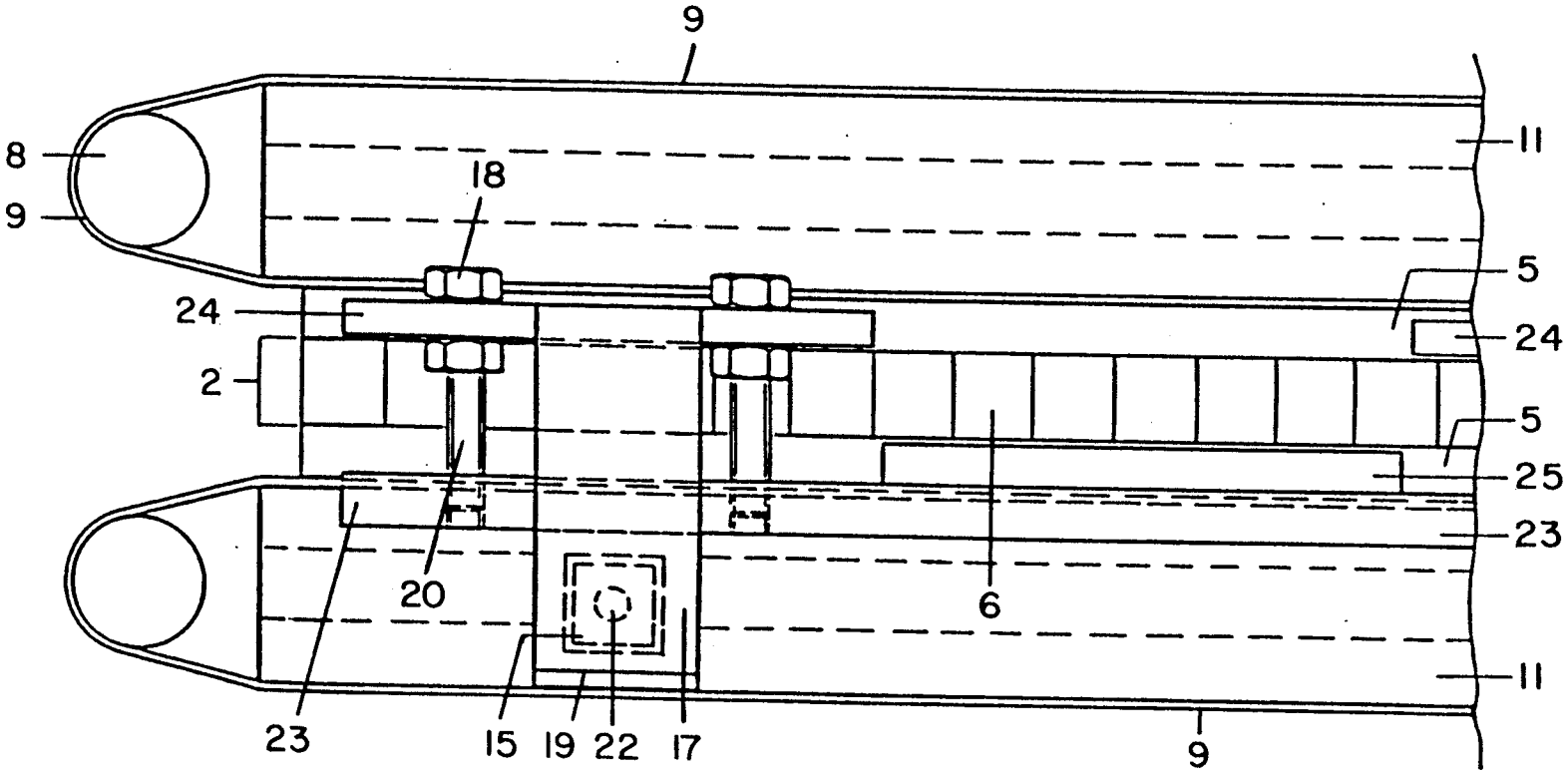
FIG. 4 is a side view of a daylight stage having separated pressure strips.

To put the laminated stacks 1 into and to take the laminated wood panels out of the daylight stages, the conveying belts 9 are of endless construction and are arranged so as to be driveable around the heating plates 11 via deflection rollers 8 as shown in FIG. 4.

To manufacture thin laminated wood panels, the present invention contemplates the pressure strips 14, for every longitudinal side, to be constructed in several pieces. Thus, according to FIG. 4, each upper and lower lid 10, 12 consists of a plurality of individual pressure strips 24 or 25 arranged at a distance from one another, no matching piece being allocated at the bottom to each of the upper pressure strips 24 so that the upper pressure strips 24 can be displaced into the intermediate space between two lower pressure strips 25 to intermesh in a tooth-shaped manner. Accordingly, it is possible to manufacture laminated wood panels having a thickness which is the same as the thickness of the pressure strips 24 and 25. While the lower pressure strips 25, like the lower lid 12, are firmly attached directly to a supporting plate 23 extending over the entire longitudinal side, the upper distance strips 24 are arranged so as to be vertically adjustable by means of adjusting screws 18 in the supporting plate 23. For this purpose, the angular supporting plate 23 is firmly connected to the thrust strip 17 and the piston 22. If the press is operated with pressure devices 15, 17 and 22 arranged on both longitudinal sides, precautions must be taken to ensure that the laminated stack 1 is not pushed back and forth on the pressing surface 16 or the conveying belt 9. To this end, preferably interchangeable distance rings 21 are provided on the piston rod 22, which distance rings 21 serve as a stop for the thrust strip 17 and thus limit the push-in movement of the pressure strips 14, 24 and 25. It may then be necessary to alter the clearance distance "a" between the pressing surfaces 16 and the pressure strips 14 if the press operates with conveying or pressing plates of different thicknesses. This can be achieved by guide brackets 19 adjustable in their height on the heating plates 11.

Figure 3:
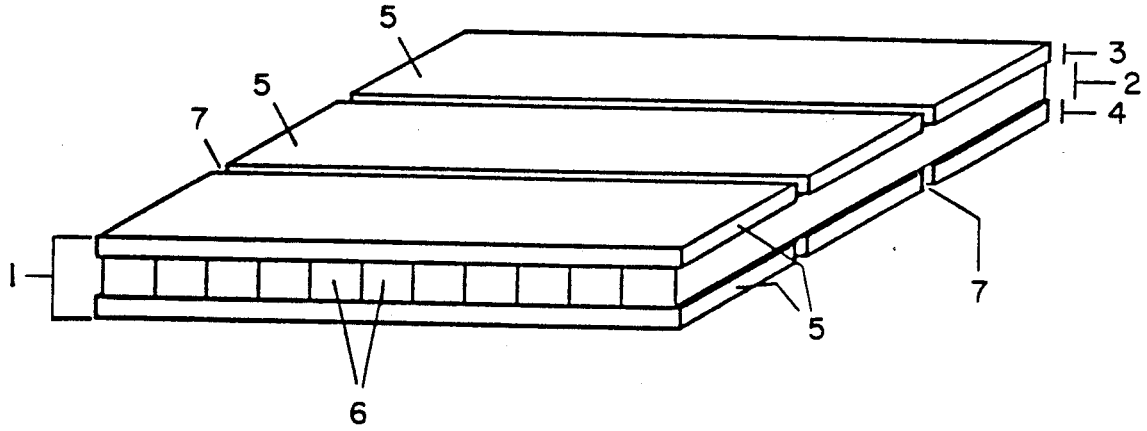
FIG. 3 is a perspective view of a laminated stack.

FIG. 3 shows a laminated stack 1 in the condition in which it is moved into the press. The core layer 2 consists of the wooden beams 6 already glued. The wooden boards 5 provided with fresh glue are attached with gaps 7 in between the boards 5 as an upper facing layer 3 and a lower facing layer 4 to the core layer 2. The device according to the invention can be successfully used in both multi-daylight and single-daylight presses.

It should become obvious to those skilled in the art that this invention is not limited to the preferred embodiments shown and described.

What is claimed is:

1. A pressure strip assembly for use with a daylight press having a pressing plane disposed between two opposed heating plates, said pressure strip assembly comprising:

a pressure strip having a portion with a height which is adjustable with respect to the remainder of the pressure strip, said pressure strip being disposed along a longitudinal side of the press;

means for guiding said pressure strip into and out of the pressing plane so that an adjustable clearance is defined between the heating plates and the pressure strip, said guiding means comprising a pressure cylinder; and means for supporting said pressure strip on said press.

2. The pressure strip assembly according to claim 1, wherein the adjustable clearance is the equal to or greater than the thickness of a conveying means of the press.

3. The pressure strip assembly according to claim 2, wherein the width of a laminated stack placed in the press is smaller than the width of the conveying means.

4. The pressure strip assembly according to claim 2, wherein the pressure strip, when guided into the pressing plane, leaves a smaller pressing width clearance than a pressing width covered by the width of the conveying means.

5. The pressure strip assembly according to claim 1, wherein the pressure strip is constructed in the shape of an open-ended box, and the adjustable height portion comprises upper and lower lids which are movable away from and toward one another by means of adjusting screws and threads.

6. The pressure strip assembly according to claim 1, wherein the pressure strip comprises upper and lower pressure strips each comprising a plurality of individual pressure strips arranged on the retaining means to intermesh in a tooth-shaped manner.

7. The pressure strip assembly according to claim 1 wherein guidance of the pressure strip into the pressing plane is limited by distance rings disposed on a piston which cooperates with the pressure cylinder.

8. The pressure strip assembly according to claim 1, wherein the retaining means comprise guide brackets which are attached in a vertically adjustable manner to one of said heating plates.

9. A laminated wood panel manufacturing device for use with a daylight press, said daylight press comprising daylight stages, at least two opposed heating plates creating a pressing plane therebetween, each of the heating plates having conveying means, said conveying means being moveable in a longitudinal direction of the press, said heating plates being moveable in a vertical direction of the press, said laminated wood panel manufacturing device comprising:

a pressure strip arranged in the longitudinal direction of the press;

an upper and a lower lid attached to and extending from said pressure strip in a transverse direction of the press;

said upper and lower lids being substantially parallel to each other and separated from each other by an adjustable first vertical dimension, said upper and lower lids each being separated from the heating plates by a second vertical dimension;

means for moving said pressure strip and said attached upper and lower lids in a transverse direction of the press, so that said upper and lower lids are moved into the pressing plane;

whereby during pressing, the upper and lower lids abut upper and lower board layers of a laminated stack to press said board layers together in a transverse direction of the press.

10. The device according to claim 9, wherein said second vertical dimension is greater than or equal to the vertical thickness of said conveying means of the press.

11. The device according to claim 9, wherein said pressure strip and said upper and lower lids, when moved into the extended position, leave a smaller pressing width clearance than a clearance covered by the width of the conveying means.

12. The device according to claim 9, wherein said pressure strip comprises an open-ended box having an adjustable height.

13. The device according to claim 9, further comprising a means for adjusting said first vertical dimension.

14. The device according to claim 13, wherein said means for adjusting comprises a plurality of adjusting screws, said adjusting screws being freely rotatable in said upper lid and threadedly engaging said lower lid.

15. The device according to claim 9, wherein said means for moving in a transverse direction comprises a piston and cylinder assembly.

16. The device according to claim 15, wherein said piston cylinder assembly is attached to a thrust strip of said pressure strip.

17. The device according to claim 15, further comprising distance rings disposed about said piston assembly to limit transverse movement of the pressure strip and the upper and lower lids.

18. The device according to claim 15, further comprising a means for attaching said piston and cylinder assembly to the press.

19. The device according to claim 18, wherein said means for attaching comprises guide brackets adjustably attached to at least one of the heating plates.

20. A daylight press for manufacturing laminated wood panels, comprising:

two heating plates arranged substantially parallel to each other to define a horizontal pressing plane therebetween;

endless rotatable conveying means disposed about each of said heating plates, said conveying means being rotatable in a longitudinal direction of the press;

said heating plates being movable in a vertical direction of the press;

a pressure strip arranged in the longitudinal direction of the press;

an upper and lower lid attached to and extending from said pressure strip in a transverse direction of the press;

said upper and lower lids being substantially parallel to each other and separated from each other by an adjustable first vertical dimension, said upper and lower lids each being separated from the heating plates by a second vertical dimension;

means for moving said pressure strip and said attached upper and lower lids in a transverse direction of the press, so that said upper and lower lids are moved into said pressing plane;

whereby during pressing, the upper and lower lids abut upper and lower board layers of a laminated stack to press said board layers together in a transverse direction of the press.

21. The press according to claim 20, wherein the transverse width of said conveying means is greater than the transverse width of a laminated stack placed in said pressing plane.

* * * * *